US007426757B2

(12) United States Patent
Lev et al.

(10) Patent No.: US 7,426,757 B2
(45) Date of Patent: Sep. 23, 2008

(54) BATH APPARATUS WITH HANDLE AND AUXILIARY FEATURES

(75) Inventors: Mordechai Lev, West Bloomfield, MI (US); Stephen Chung, Taipei (TW); Barbara A. Westfield, Waterford, MI (US)

(73) Assignee: FKA Distributing Co., Commerce Township, MI (US)

( * ) Notice: Subject to any disclaimer, the term of this patent is extended or adjusted under 35 U.S.C. 154(b) by 325 days.

(21) Appl. No.: 11/083,594

(22) Filed: Mar. 18, 2005

(65) Prior Publication Data

US 2006/0207016 A1 Sep. 21, 2006

(51) Int. Cl.
*A47K 3/022* (2006.01)

(52) U.S. Cl. ..... 4/622; 220/761

(58) Field of Classification Search ..... 4/622; 220/761, 774

See application file for complete search history.

(56) References Cited

U.S. PATENT DOCUMENTS

| | | | | | |
|---|---|---|---|---|---|
| 60,337 | A | * | 12/1866 | Brown | 220/774 |
| 60,521 | A | | 12/1866 | Isaacs | 4/622 |
| 1,260,794 | A | * | 3/1918 | Paquette | 220/774 X |
| 1,534,618 | A | | 4/1925 | Taylor et al. | 4/622 |
| 2,127,958 | A | * | 8/1938 | McCormick | 220/765 |
| 2,189,127 | A | * | 2/1940 | Brannon | 219/438 |
| 3,055,357 | A | | 9/1962 | Redka | 601/46 |
| 3,283,756 | A | | 11/1966 | Turley | 601/166 |
| 4,620,529 | A | * | 11/1986 | Kurosawa | 601/157 |
| 4,807,602 | A | * | 2/1989 | Scarborough et al. | 601/104 |
| 5,207,476 | A | | 5/1993 | Payne | 16/445 X |
| 5,324,094 | A | | 6/1994 | Kain | 16/430 X |
| 5,758,370 | A | | 6/1998 | Schwartz | 4/622 |
| 6,309,366 | B1 | * | 10/2001 | Maxwell | 601/166 |
| D453,836 | S | | 2/2002 | Gillette et al. | D24/213 |
| 6,385,795 | B1 | * | 5/2002 | Ferber et al. | 4/622 |
| 6,405,390 | B2 | | 6/2002 | Kuen | 4/622 |
| 6,568,000 | B1 | * | 5/2003 | Kaufman et al. | 4/622 |
| 6,632,188 | B2 | | 10/2003 | Thomas et al. | 601/152 |
| 6,679,857 | B1 | | 1/2004 | Bastia et al. | 601/72 |
| 6,698,038 | B2 | * | 3/2004 | Bastia et al. | 4/622 |
| 6,911,010 | B2 | | 6/2005 | Dirks et al. | |

(Continued)

FOREIGN PATENT DOCUMENTS

JP H06-339509 A 12/1994

(Continued)

OTHER PUBLICATIONS http://www.shoplifestyle.com, Ultra massaging heated foot spa—30 Day Money Back Guarantee, 2 pages, copyright 1999-2003.

(Continued)

*Primary Examiner*—Robert M Fetsuga
(74) *Attorney, Agent, or Firm*—Brooks Kushman P.C.

(57) ABSTRACT

The present invention discloses a bath apparatus having auxiliary features. The auxiliary features include a handle for providing ergonomic manual transportation of the bath apparatus. Additionally, improvements to conventional therapeutic effects are provided for enhancing the overall therapeutic bathing experience. Further, a bath apparatus is disclosed having a pedicure apparatus for providing a motorized rotary pedicure effect to the user. Even further, a bath apparatus having a fluid dispenser is disclosed for dispensing therapeutic additives.

6 Claims, 11 Drawing Sheets

U.S. PATENT DOCUMENTS

| | | | | |
|---|---|---|---|---|
| 7,192,406 | B2 | 3/2007 | Marten | 601/127 |
| 2003/0120185 | A1 | 6/2003 | Dirks et al. | |
| 2004/0002666 | A1 | 1/2004 | Chen | 601/17 |
| 2005/0081292 | A1 | 4/2005 | Lev et al. | 4/622 |

FOREIGN PATENT DOCUMENTS

| | | | |
|---|---|---|---|
| WO | 2006101820 | A1 | 9/2006 |

OTHER PUBLICATIONS

HoMedics Body Basics, SoleMate Portable Pedicure Kit, Instruction Manual and Warranty Information, 2 pages, copyright 2001-2003.

Patent Cooperation Treaty International Search Report and Written Opinion for related application PCT/US06/09056, mailed Aug. 3, 2006, 7 pages.

International Preliminary Report for corresponding International Application. No. PCT/US06/09056, mailed Jul. 13, 2007 , 5 pages.

Office Action for U.S. Appl. No. 11/083,725, mailed Jul. 2, 2007, 9 pages.

* cited by examiner

BATH APPARATUS WITH HANDLE AND AUXILIARY FEATURES

BACKGROUND OF THE INVENTION

1. Field of the Invention

The invention relates to an apparatus for bathing body parts, such as the feet or hands.

2. Background Art

Most people experience foot problems at some time in their lives. This is not surprising, considering that many people are employed in jobs that require them to be on their feet all day. In fact, even an average day of walking can exert force equal to several hundred tons of pressure on the feet.

In an attempt to alleviate a variety of podiatric problems, bathing of the feet has become a recognized therapeutic method. For example, soaking soothes the feet and aids in recovery from fatigue. Bathing of the feet also stimulates the circulation of blood therethrough, which results in increased metabolism and excretion. In addition, foot bathing facilitates the removal of painful growths such as calluses, bunions, and corns.

Many types of footbaths have been utilized as therapeutic devices for the feet. Typically, footbaths provide heated water for which the temperature is maintained via electrical means. In addition, current footbaths often provide massage to the feet through vibration of the footbath. Vibratory massage enhances the therapeutic results achieved with soaking alone by further increasing circulation, as well as relaxing and massaging the muscles.

Conventional footbaths may be difficult and/or awkward to transport, fill and empty due to size, weight and difficulty of stabilizing the footbath to prevent splashing or spilling of water from the footbath. The water in the footbath also adds to the weight, thereby increasing the difficulty in manual transportation. The prior art has offered footbaths with handles that are typically on the backside or underside of the bath chamber, and thus, are only useful when the bath chamber is empty and the water is not a factor.

The prior art has also provided footbaths having a peripheral rim or one or more handles displaced about the peripheral rim. Although such peripheral handles are useful for transporting the footbath in an empty condition, two-handed carrying is necessitated. Two-handed carrying may be awkward by requiring the user to carry the footbath close to his/her body. Such transportation often lacks in ergonomics and results in unsteady movements, thereby causing splashing or spilling of the fluid therein.

The prior art has offered various massage features such as rotary massage attachments on the housing of the footbath, for providing a targeted massage or therapeutic effect to a body part of the user. Oftentimes, such features require the user to rest the body on the housing adjacent to the massage attachment. Due to the structural rigidity of the adjacent housing portion, such resting may be uncomfortable or awkward. Additionally, it may difficult for a user to convey the targeted body part to the massage feature.

Personal care for one's feet often extends outside the realm of features conventionally provided in footbaths. For example, consumers may treat their feet to pedicures and lotions as well as bathing, massage and therapy.

Therefore, a need exists for a footbath that can be transported ergonomically when filled or empty. A need also exists to enhance comfort to a user when operating auxiliary features of a footbath. Incorporation of various foot treatment features into a footbath is also needed so that a user may experience a variety podiatric and pedicure features from a single apparatus.

SUMMARY OF THE INVENTION

An aspect of the present invention is to provide an apparatus for bathing a body part. The apparatus has a bath chamber for containing fluid with an opening for receiving the body part. A housing is mounted to the bath chamber for retaining an operational assembly that imparts a therapeutic effect to the bath chamber. The housing provides a base for supporting the bath chamber. A handle is mounted to one of the bath chamber and the housing for providing a grip portion that extends above the bath chamber and a center of gravity of the bath apparatus for facilitating manual transportation of the apparatus when filled.

A further aspect of the present invention is to provide a spout formed in the bath chamber for emptying the bath chamber.

Another aspect of the present invention is to provide the handle grip portion generally perpendicular to a pivot axis of the handle for enhancing ergonomic grasping and transportation.

Yet another aspect of the present invention is to provide a plurality of attachment points for attaching the handle in multiple positions.

A further aspect of the present invention is wherein the handle is mounted to the bath chamber and the bath chamber is removable from the housing.

Another aspect of the present invention is wherein the handle has a retracted and an extended position.

Yet another aspect of the present invention is to provide a locking mechanism for securing the handle in a fixed position.

Another aspect of the present invention is to provide a recess within the bath apparatus for receiving the handle in the retracted position.

Yet another aspect of the present invention is to provide a mechanism for extending the handle.

An aspect of the present invention is to provide a bath apparatus having a bath chamber for containing fluid. A pair of wheels are mounted to the bath chamber and a telescoping handle is mounted to the bath chamber so that in an extended position of the handle, the bath chamber may be transported upon the wheels.

Another aspect of the present invention is to provide a bath apparatus having a bath chamber for containing fluid, a contact area adapted to be uncovered by fluid, and a flexible contact pad mounted on the contact area for providing flexible support to a body part.

Another aspect of the present invention is to provide a bath apparatus having a bath chamber, a housing, and a motorized pedicure apparatus mounted within a receptacle on the housing.

Yet another aspect of the present invention is to provide a bath apparatus having a bath chamber and a fluid dispenser for dispensing a fluid upon manual actuation.

An even further aspect of the invention is to provide a bath apparatus having a bath chamber and a removable bristle pad disposed therein.

The above aspects, and other aspects, objects, features, advantages, embodiments and benefits of the present invention are readily apparent from the detailed description of the embodiments of the invention when taken in connection with the accompanying drawings.

DETAILED DESCRIPTION OF EMBODIMENTS OF THE INVENTION

Figure 1:
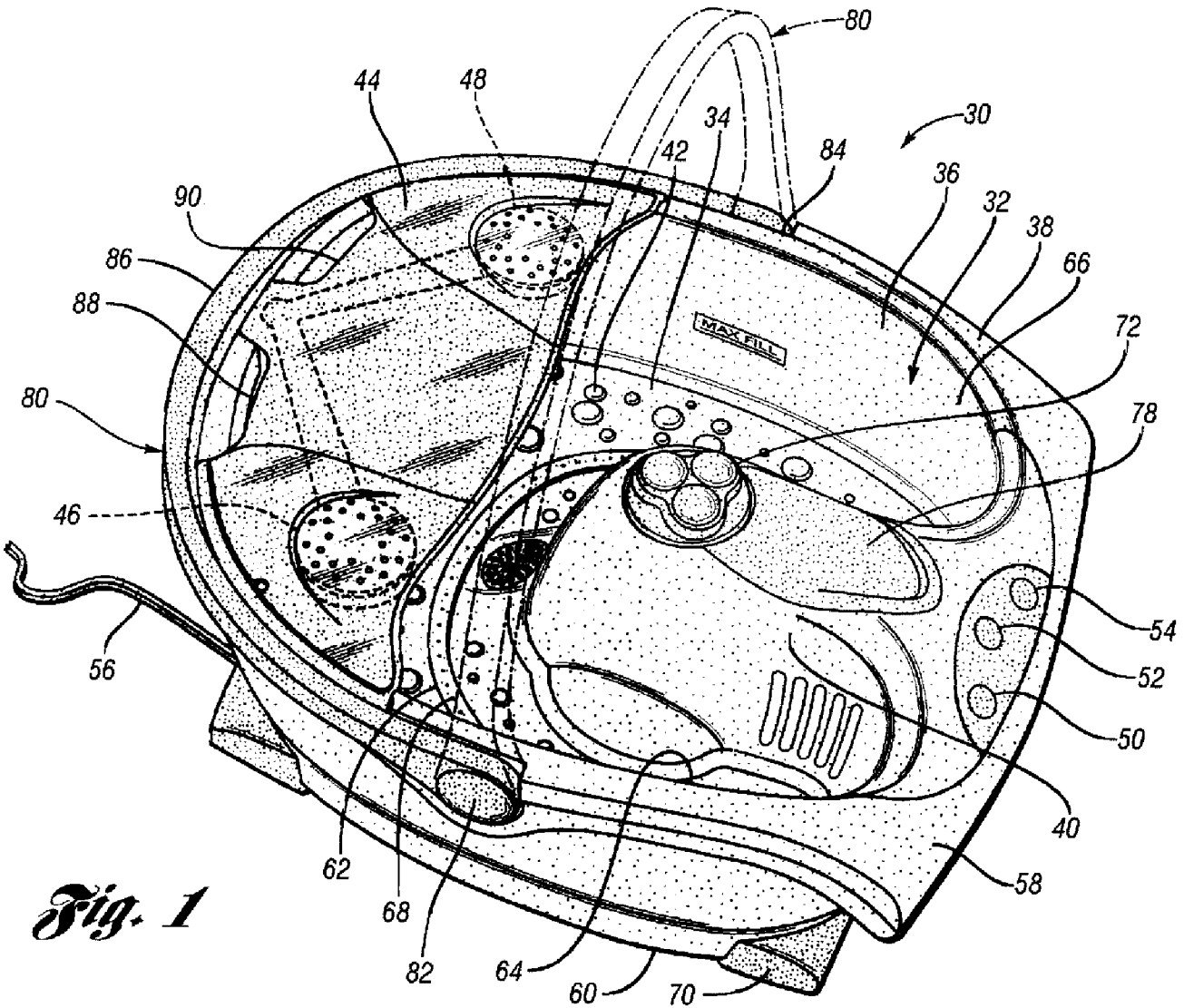
FIG. 1 is a perspective view of a bath apparatus in accordance with the present invention.

FIG. 1 shows a bath apparatus 30 in accordance with the present invention. The bath apparatus 30 can be used to provide heat, water jets, bubbles, and combinations thereof to body parts, such as feet. The bath apparatus 30 is preferably constructed from a plastic material so as to be lightweight and portable, as well as durable, leakproof, and corrosion resistant. Although the bath apparatus 30 is illustrated and described herein as being particularly adaptable for use as a footbath, it is understood that the bath apparatus 30 of the present invention may be used for bathing other body parts, such as the hands.

The bath apparatus 30 includes a bath chamber 32 for containing fluid, such as water, and receiving the body part, such as the foot, therein. The bath chamber 32 includes a bottom surface 34 and a wall structure 36 extending upwardly therefrom. The wall structure 36 terminates in an upper surface 38 that includes a contact portion 40 adapted to be exposed when water is contained in the bath chamber 32. The bottom surface 34 can be generally parallel to a supporting surface on which the bath apparatus 30 is placed, or alternatively, the bottom surface 34 could be slanted downward toward the user.

The bath chamber 32 is of a length and width to accommodate the feet of an adult user, such that sufficient space is provided for the user's feet to be readily inserted and removed, and to allow the feet to be moved about slightly while in position within the bath chamber 32. In a preferred embodiment, the bath chamber 32 is generally U-shaped and the contact portion 40 is generally peninsular and centrally disposed within the bath chamber 32. With this configuration, a use's feet are received on either side of the peninsular contact portion 40, wherein the feet are spaced apart sufficiently to provide comfortable placement. For use, the bath chamber 32 is filled with water to a level such that a use's feet may be submerged up to approximately the height of the ankles. A maximum fill level may be indicated, such as the marking illustrated in FIG. 1, so that an optimal fill level is obtained with the combination of water and feet placed within the bath chamber 32. A user can then easily remove his/her feet for placement on contact portion 40 for targeted therapy as described below. Of course, it is understood that contact portion 40 can have any location on bath apparatus 30 which remains uncovered by water and is accessible to the user.

Figure 2:
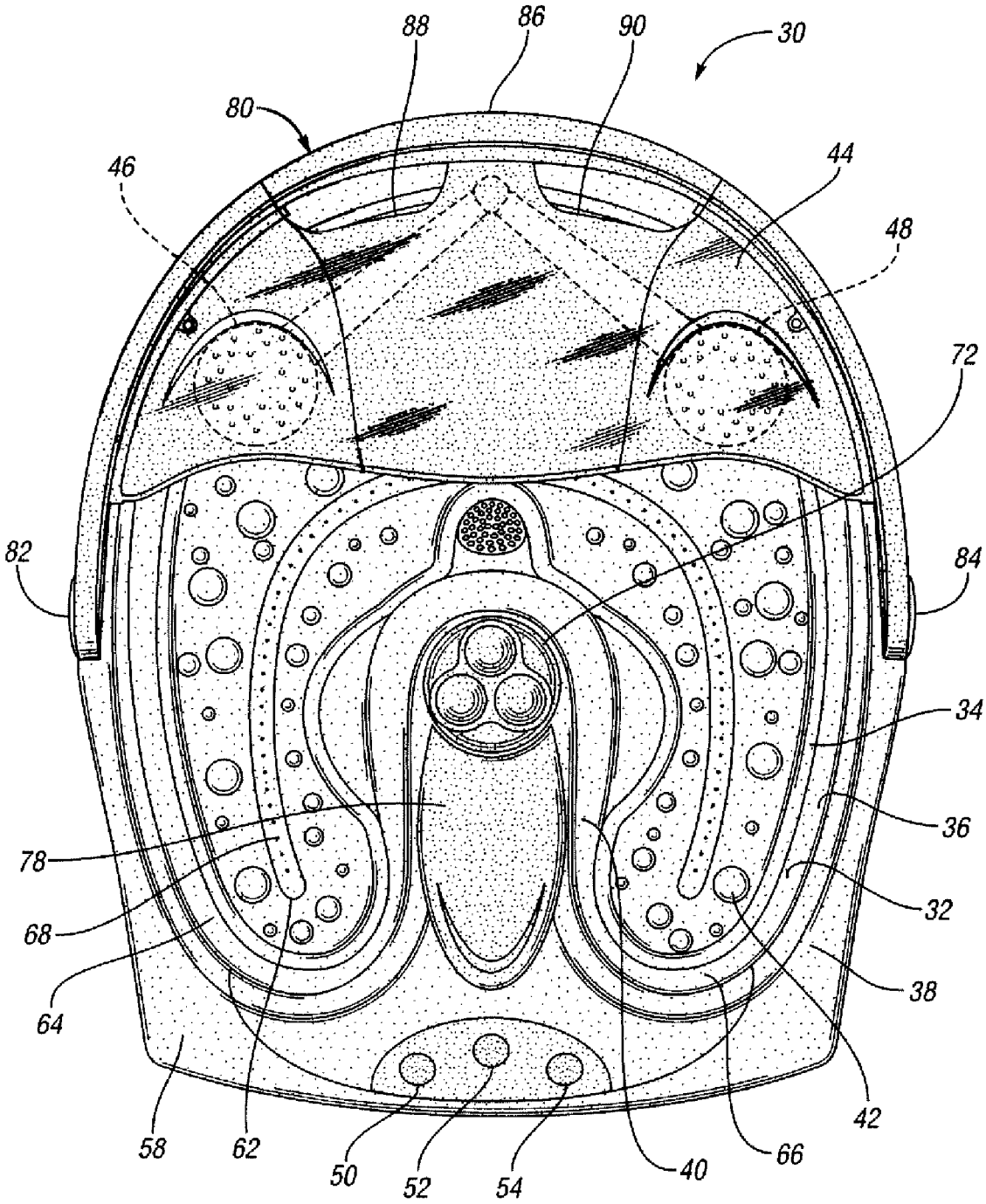
FIG. 2 is a top plan view of the bath apparatus shown in FIG. 1.

With reference to FIGS. 1 and 2, the bottom surface 34 of bath chamber 32 includes a plurality of raised nodes 42 which can be of varying sizes. The nodes 42 function to massage the feet upon contact, and also allow water to flow under them. As shown in FIGS. 1 and 2, bath apparatus 30 further includes a lid 44 adapted to be attached to the wall structure 36 to at least partially cover an opening of the bath chamber 32. The lid 44 is preferably constructed from a plastic material, and is sufficiently rigid so that it can be used as a foot rest when only one foot is submersed with the bath chamber 32. The lid 44 also includes a pair of showerheads 46, 48 for providing a pressurized fluid massage effect to the user's feet when disposed within the bath chamber 32. The details of the showerheads 46, 48 are discussed in greater detail in assignee's copending application titled Bath Apparatus with Pressurized Fluid Massage, filed on Mar. 18, 2005, Ser. No. 11/083,725, which is incorporated in its entirety by reference herein.

The bath apparatus 30 includes three operational switches, namely massage/heat switch 50, shower switch 52 and bubbles/heat switch 54. Each switch 50, 52, 54 operates a feature independent of one another so that a user may select one or a combination of these features. Wiring interconnects the switches 50, 52, 54 with each of the corresponding mechanical/electrical operational assemblies described below, which are then powered via connection of a standard power cord 56 to any 110 V AC outlet.

Figure 3:
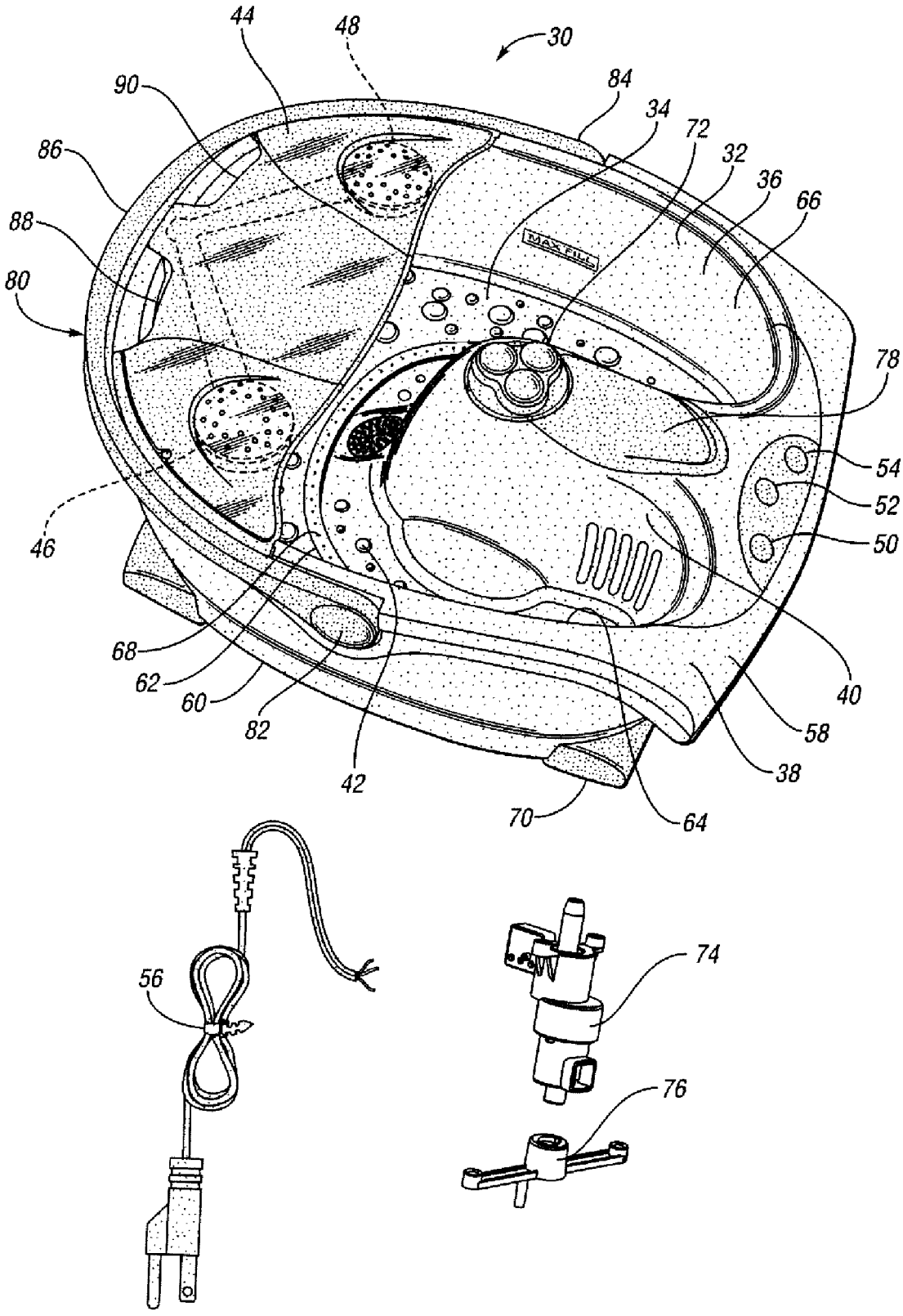
FIG. 3 is a partially exploded view of the bath apparatus shown in FIG. 1.

Referring now to FIGS. 1-3, several mechanical/electrical operational assemblies of bath apparatus 30 of the present invention will now be described. The bath chamber 32 is provided within an upper housing portion 58. Each of the following operational assemblies is housed in a cavity provided between the upper housing portion 58 and a lower housing portion 60. One operational assembly, a heater (not shown) is provided in communication with the bath chamber 32 and is powered by either of the massage/heat switch 50 and bubbles/heat switch 54. The heater may be a rope heating element that is operable to conduct heat to the water contained within the bath chamber 32. The heated water maintained by the rope heating element relieves tired muscles and promotes circulation of the blood. The rope heating element is positioned to wind back and forth to substantially cover bath chamber bottom surface 34. The rope heating element preferably includes insulated conducting wires, wherein the conductive materials are capable of transmitting heat to the bath chamber bottom surface 34 without generating temperatures that exceed the melting point of the plastic material used to construct the bath apparatus.

Rope heating elements are well known in the art of footbaths and are disclosed in assignee's U.S. Pat. No. 6,568,000 B1 issued to Kaufman et al., titled Bath Apparatus with Therapy Centers; and U.S. Pat. No. 6,725,471 B2 issued to Ferber et al., titled Bath Apparatus. The Kaufman et al. and Ferber et al. patents are incorporated in their entirety by reference herein.

The bath apparatus 30 further includes a motorized operational assembly, an air pump (not shown), disposed adjacent to bottom surface 34 of bath chamber 32 and in communication therewith. The pump is turned on and off by the bubbles/heat switch 54. The pump directs air into bath chamber 32 to generate air bubbles in the water contained therein. The pump forces air through an outlet tube which is connected to an injection molded bubble egress strip or tube 62 formed in communication with bath chamber bottom surface 34. The egress tube 62 is generally U-shaped and extends from a first side 64 to a second side 66 of the bath chamber bottom surface 34. Air is forced out of a plurality of egress holes 68 that are provided along the bubble egress tube 62 to form air bubbles in the water contained in bath chamber 32. Of course, the outlet tube and the egress tube 62 could be constructed as a single component. Alternatively, one egress tube could be disposed within the first side 64 of bottom surface 34, and another egress tube could be disposed within the second side 66 of bottom surface 34.

In addition to the generally U-shaped configuration of the bubble egress tube 62 depicted in FIGS. 1 and 2, the bubble egress tube 62 can be constructed to have various configurations which provide more complete coverage of bath chamber bottom surface 34. For example, bubble egress tube 62 can have a linear configuration, a continuous curvilinear configuration, including at least one generally S-shaped segment or at least one reverse curve, such as a serpentine configuration, as illustrated in the Ferber et al. U.S. Pat. No. 6,725,471 patent. Alternatively, the bubble egress tube 62 can include a continuous configuration of linear segments, such as a square-wave or a sawtooth configuration, as illustrated in the Ferber et al. U.S. Pat. No. 6,725,471 patent.

The bubble egress tube 62 is disposed below the bath chamber bottom surface 34, such that the plurality of egress holes 68 are flush with bottom surface 34. Alternatively, the bubble egress tube 62 may protrude at least partially above bottom surface 34, such that egress holes 68 are raised above bottom surface 34. The plurality of bubble egress holes 68 can be positioned at multiple axial locations along the egress tube 62, thereby providing an even greater ability to generate bubbles within a given area of bottom surface 34.

Still further, bath apparatus 30 includes another motorized operational assembly, a vibration assembly (not shown), in communication with bath chamber 32 for imparting vibration to bath chamber 32 to provide a massaging effect to the feet. The vibration assembly is turned on and off by actuation of the massage/heat switch 50. The vibration assembly includes a motor affixed to an underside of bath chamber 32, an output shaft rotatably driven by the motor, and a counterweight affixed to the output shaft. The vibration assembly is affixed underneath a central portion of bath chamber 32 by a motor support bracket. When the motor is electrically powered by actuation of massage/heat switch 50, rotation of the output shaft and the attached counterweight imparts vibrations to the motor support bracket, and these vibrations are then transferred to bath chamber 32 and the water contained therein in order to massage the feet. Foot baths with vibration assemblies are disclosed in further detail in the Kaufman et al. 6,568,000 and Ferber et al. 6,725,471 patents, which have been incorporated by reference. The lower housing portion 60 includes a plurality of feet 70 constructed from a material such as rubber to resist movement of bath apparatus 30 along a supporting surface. It is fully contemplated that variable vibration intensities could be provided in accordance with the present invention.

The contact portion 40 is configured to receive massage attachments such as massage attachment 72, or such as the attachments disclosed in the Ferber et al. U.S. 6,725,471 patent. Massage attachments are a motorized operational assembly that advantageously allow for massage to be targeted to specific locations of the foot such as the ball, heel, or arch. As shown in FIG. 3, a motor 74 is disposed on an underside of the bath chamber 32, and may be attached to the underside of the contact portion 40 or to the lower housing portion 60 with a motor bracket 76, using screws (not shown). The various massage attachments are adapted to be received on an output shaft that is rotatably driven by the motor 74 and adapted to be accessible through the contact portion 40. The motorized rotation of the massage attachments such as the massage attachment 72, is activated by pressure of a body part applied thereon, which then establishes electrical contact to supply power to the motor 74. Alternatively, the motor 74 can be configured to operate when the user actuates a manual switch (not shown).

The contact portion 40 also includes a gel pad 78 mounted proximate to the massage attachment 72 for providing comfortable, padded, flexible support to a portion of the use's foot, such as the heel, as the user receives a massage effect from the massage attachment 72. The gel pad 78 enhances traction and friction for steady placement of the use's foot or other body part without slipping off of the contact portion 40. Additionally the gel pad 78 is much softer than the typically structurally rigid contact portion 40.

A fluid pump, which is another motorized operational assembly, may also be provided for pumping water through the showerheads 46, 48. The pump is controlled by the shower switch 52.

Referring now to FIGS. 1 to 3, the bath apparatus 30 further includes a handle 80. The handle 80 is generally arcuate and is pivotally connected to the bath chamber upper surface 38 at pivotal connections 82, 84 on lateral sides thereof. In the retracted orientation of the handle 80, as illustrated in FIGS. 1 to 3, the handle 80 is streamlined into an aesthetic appearance of the bath chamber upper surface 38. The pivotal connections 82, 84 are provided so that when the handle 80 is pivoted to an extended orientation, as illustrated in phantom in FIG. 1, a central portion 86 of the handle 80 is disposed over a center of gravity of the bath apparatus 30 and fluid retained therein. Thus, the handle 80 assists in manual transportation and portability of the bath apparatus 30. Although a pair of pivotal connections 82, 84 are illustrated, the invention contemplates that the handle 80 may have only one pivotal connection and the handle 80 may be cantilevered from the pivotal connection.

One-handed transportation is capable by providing the handle 80 with the central grip portion 86 displaced above and generally aligned with the center of gravity of the bath apparatus 30 when filled with fluid. This transportation permits the user to carry the bath apparatus 30 by the use's side, resulting in steady transportation, thereby minimizing spilling and splashing.

The lid 44 generally lessens spilling and splashing during transportation and operation of the bath apparatus 30 by covering a portion of the opening of the bath chamber 32. The lid 44 is further provided with a pair of spouts 88, 90 each disposed adjacent to, and on lateral sides of duct work to the showerheads 46, 48. The spouts 88, 90 provide openings in the lid 44 such that a user may dispose the fluid within the bath chamber 32 by grasping the handle 80 in the upright position and tilting the bath chamber 32 into an orientation wherein the spouts 88, 90 are lowered relative to the pivotal connections 82, 84. Thus, the user may dispose the liquid by lifting a rear portion of the bath chamber 32 upward thereby pouring the liquid at a limited rate and region of flow for disposing the liquid. Of course, the invention contemplates that one spout or any number of spouts may be provided in the bath chamber 32.

Figure 4:
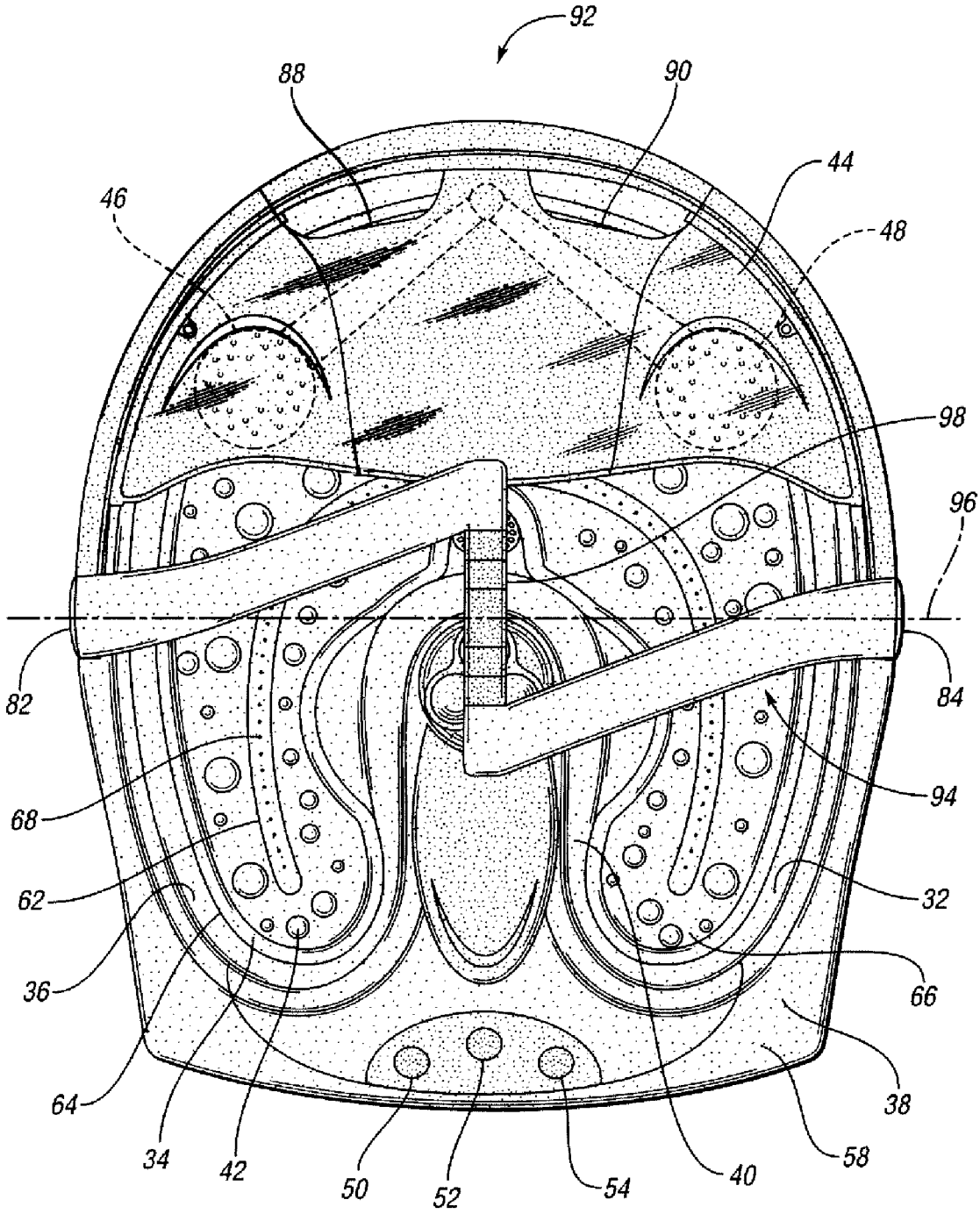
FIG. 4 is a top plan view of an alternative embodiment bath apparatus in accordance with the present invention.

Referring now to FIG. 4, an alternative embodiment bath apparatus 92 is illustrated in accordance with the present invention. Like elements retain same reference numerals wherein new elements are assigned new reference numerals. The bath apparatus 92 includes a generally arcuate handle 94 pivotally connected to lateral sides of the bath apparatus 92 at pivotal connections 82, 84. The handle 94 pivots about a pivot axis 96 between an extended position and a retracted position. The handle 94 includes a central grip portion 98 that is displaced generally perpendicular to the pivot axis 96. This orientation of the central grip portion 98 facilitates ergonomic transportation, such that a user may grasp the grip portion 98 and carry the bath apparatus 92 with one hand adjacent to a side of the user, without having to rotate the use's wrist. Thus, with the offset central grip portion 98, the user may transport the bath apparatus 92 by grasping the handle 94 in an orientation that is relatively natural and ergonomic for positioning a use's arm and wrist at the use's side.

Figure 5:
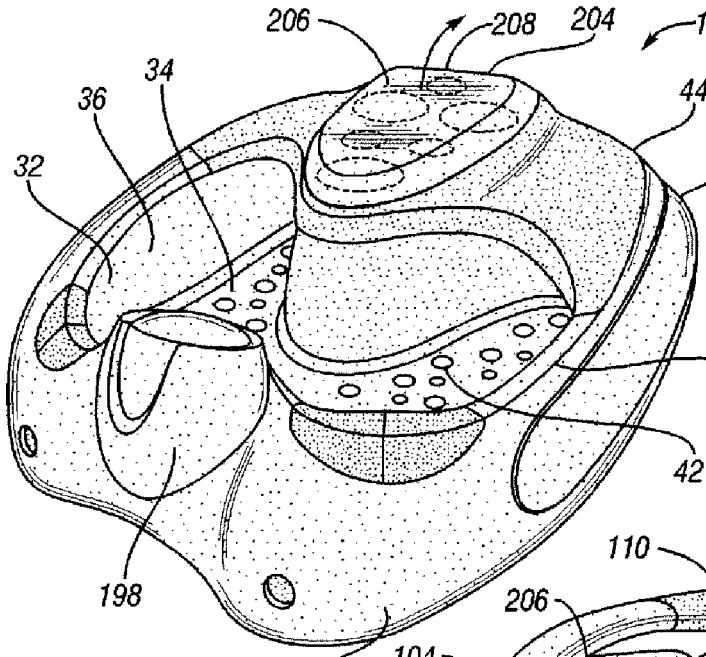
FIG. 5 is a perspective view of another alternative embodiment bath apparatus in accordance with the present invention.
Figure 6:
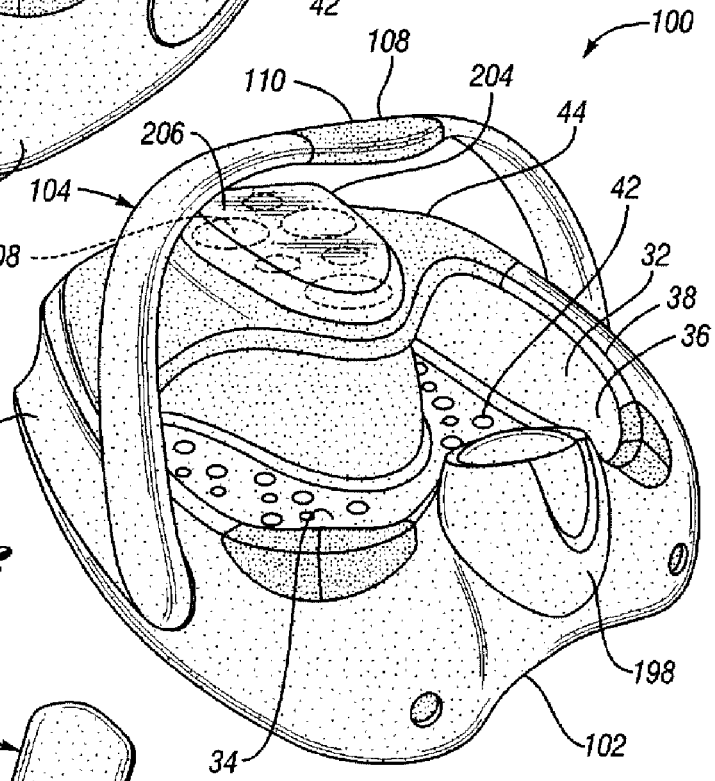
FIG. 6 is a perspective view of the bath apparatus of FIG. 5, illustrated with a handle in an extended position.
Figure 7:
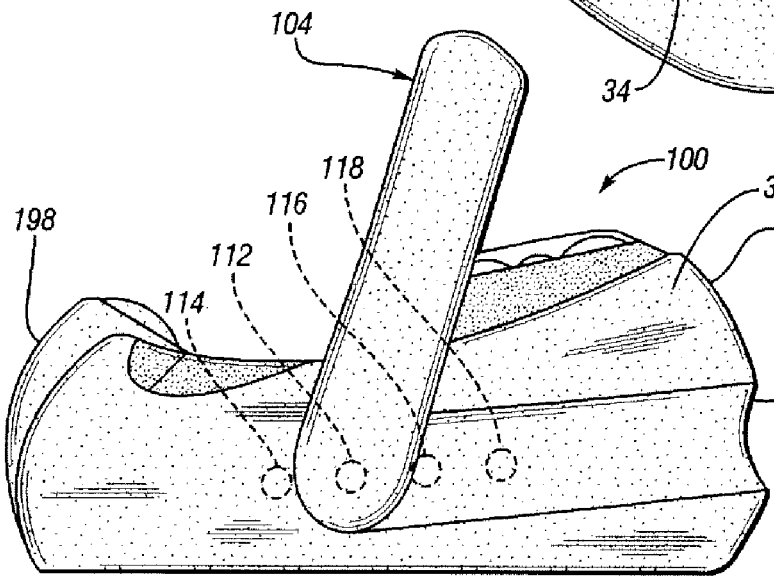
FIG. 7 is a side elevation view of the bath apparatus of FIG. 5, illustrated with the handle in the extended position.

With reference now to FIGS. 5 through 7, an alternative embodiment bath apparatus 100 is illustrated in accordance with the present invention. The bath apparatus 100 has a housing 102 with a generally arcuate handle 104 pivotally connected to lateral sides thereof for a retracted position as illustrated in FIG. 5, and an extended position as illustrated in FIGS. 6 and 7. Unlike the prior embodiment wherein the handle 80 is streamlined into the peripheral rim of the bath chamber 32 and the upper surface 38, the handle 104 of the bath apparatus 100 is oriented outboard of the bath chamber 32. Further, the handle 104 is disposed beneath the bath apparatus upper surface 38 for providing a streamlined housing appearance.

The housing 102 includes a recess 106 formed thereabout for receiving the handle 104 in the retracted position thereby enhancing compactness of the housing 102 and handle 104.

As illustrated in FIGS. 6 and 7, the handle 104 extends to an orientation wherein a central grip portion 108 is disposed above the center of gravity of the bath apparatus 100. Additionally, the central grip portion 108 may be provided with an overmolded elastomeric grip surface 110 for enhancing a use's grasp about the grip portion 108.

With reference now to FIG. 7, a pivotal connection for the handle 104 is illustrated with dashed lines and referenced by numeral 112. The invention contemplates multiple pivotal connection points such as pivotal connections labeled with numerals 114, 116, 118. By providing multiple pivotal connection points, the user may mount the handle 104 to a desired position on the housing 102 thereby facilitating customized handle orientations for filling, emptying or transporting the bath apparatus 100.

Figure 8:
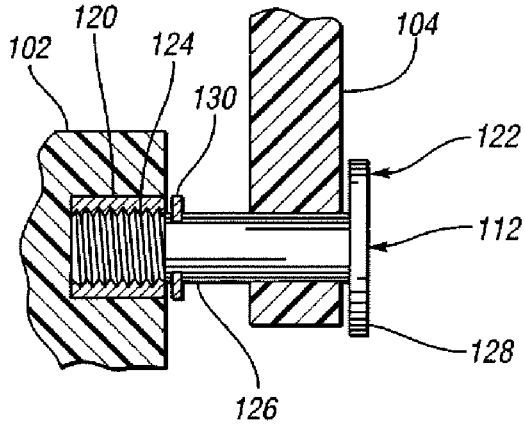
FIG. 8 is an enlarged partial section view of an exemplary pivotal connection between a handle and a bath apparatus in accordance with the present invention.

With reference now to FIG. 8, an exemplary embodiment pivotal connection 112 is illustrated in greater detail. The housing 102 includes a plurality of threaded inserts that are insert-molded into the housing 102, such as threaded insert 120 that is illustrated at pivotal connection 112. A threaded insert 120 is provided for each of the pivotal connections 112, 114, 116, 118. The pivotal connection 112 includes a shoulder bolt 122 for securing the handle 104 to the threaded insert 120. Specifically, the shoulder bolt 122 includes a threaded end 124 that is threadably engaged within the threaded insert 120. The shoulder bolt 122 also includes a shaft body 126 extending from the threaded end 124 to a knurled head 128. The handle 104 is bearingly supported about the shaft body 126. The knurled head 128 permits a user to rotate the shoulder bolt 122 thereby disengaging the threaded end 124 from the threaded insert 120. The shaft body 126 may include a retaining clip 130 mounted thereto for retaining the shoulder bolt 122 to the handle 104 when disengaged from the housing 102. Thus, the user may unscrew the shoulder bolt 122 at the pivotal connection, such as pivotal connection 112 and reassemble the handle 104 to an alternate pivotal connection.

Figure 9:
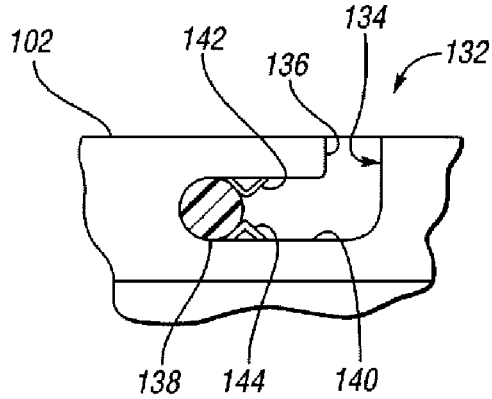
FIG. 9 is an enlarged side perspective view of an exemplary pivotal connection between a handle and a bath apparatus in accordance with the present invention.

With reference now to FIG. 9, an alternative embodiment pivotal connection 132 is illustrated for mounting the handle 104 at multiple attachment points along the housing 102. Specifically, the housing 102 includes a plurality of cam tracks such as cam track 134 formed within a lateral side of the housing 102 within a peripheral rim of the bath chamber 32. The cam track 134 includes a vertical portion 136 for insertion of a pin 138 that extends from the handle 104. The cam track 134 also includes a horizontal portion 140 for receiving the pin 138. A pair of leaf springs 142, 144 are provided within the horizontal portion 140 for snapping the pin 138 into a locked location within the horizontal portion 140. If the user desires an alternative attachment point from the pivotal connection 132, the user grasps the handle 104 and biases the handle 104 in a direction such that the pin 138 compresses the leaf springs 142, 144 thereby translating the pin 138 through the cam track 134. Thus, the user may disengage the handle 104 from the housing 102 and reengage it at another cam track 134 along the housing 102.

Figure 10:
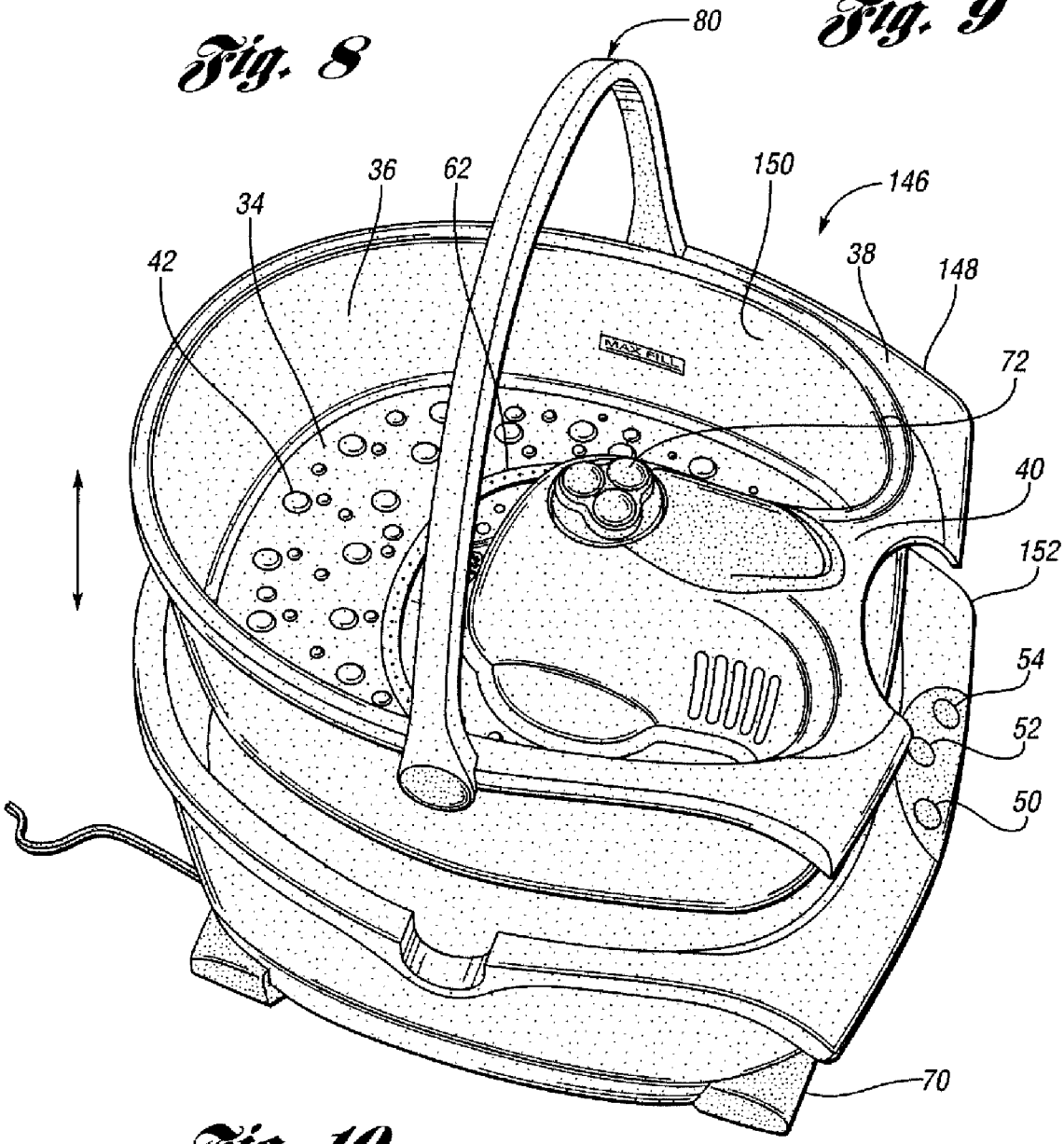
FIG. 10 is a partially exploded perspective view of an alternative embodiment bath apparatus in accordance with the present invention.

With reference to FIG. 10, an alternative embodiment bath apparatus 146 is illustrated in accordance with the present invention. Specifically, the bath apparatus 146 includes an upper housing portion 148 that includes a bath chamber 150. The upper housing portion 148 is removable from a lower housing portion 152. Thus, for filling and emptying the bath chamber 150, the user may grasp the handle 80 and remove the upper housing portion 148 from the lower housing portion 152. This arrangement of the upper and lower housing portions 148, 152 reduces the total amount of weight required for transportation by the user by retaining the therapeutic operational assemblies within the lower housing portion 152. Of course, disconnects may be provided between the operational assemblies such as a disconnect through ducting to the egress strip 62 or a disconnect at the output shaft that drives the massage attachment 72.

Figure 11:
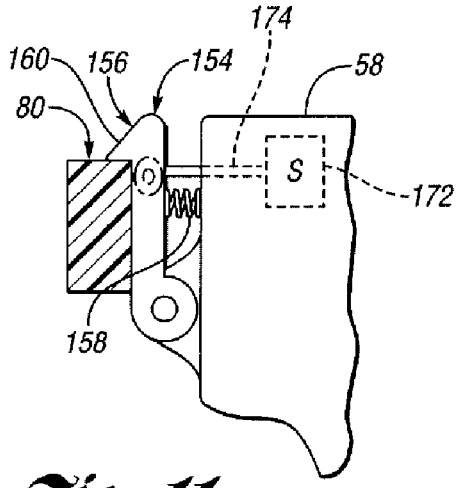
FIG. 11 is an enlarged partial section view of a bath apparatus and a handle in accordance with the present invention.

With reference now to FIG. 11, the handle 80 is illustrated in the retracted position in cooperation with a locking mechanism 154. The locking mechanism 154 may be utilized for retaining the handle 80 in the retracted position. The locking mechanism 154 includes a lever 156 pivotally connected to the upper housing portion 58. A compression spring 158 is mounted between the upper housing portion 58 and the lever 156 for extending the lever 156 to the locked orientation as illustrated in FIG. 11. Lever 156 includes a leading edge 160 so that as the handle 80 is translated from the extended position to the retracted position, the handle 80 engages the leading edge 160 thereby translating the lever 156 towards the upper housing portion 58 and compressing the spring 158. Once the handle 80 is translated fully to the retracted position, the spring 158 biases the lever 156 forward to the locked orientation.

Figure 12:
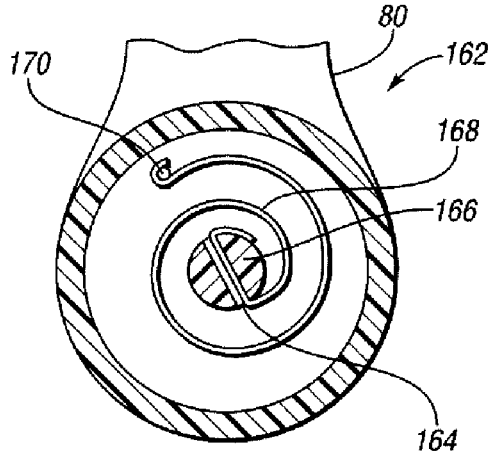
FIG. 12 is an enlarged partial section view of a pivotal connection of a bath apparatus and a handle in accordance with the present invention.

The handle 80 may include a mechanism for extending the handle 80 to the extended orientation. With reference now to FIG. 12, an enlarged partial section view of an alternative embodiment pivotal connection 162 is illustrated. The handle 80 may include an aperture 164 for receiving a pivot shaft 166 extending laterally from the bath apparatus 30. A torsion spring 168 is provided in engagement to the pivot shaft 166 of the bath apparatus 30 at a first end thereof. A second of the torsion spring 168 is engaged to a projection 170 on the handle 80. Thus, the torsion spring 168 biases the handle 80 to the upright or extended position.

The mechanism for extending the handle 80 may be electronically controlled. For example, with reference again to FIG. 11, a solenoid 172 may be provided in the upper housing portion 58. The solenoid 172 may drive a link 174 that is pivotally connected to the lever 156. Thus, the solenoid 172 may actuate the link 174 and the lever 156 thereby releasing the handle 80 so that the torsion spring 168 may extend the handle 80 to the extended position.

Figure 13:
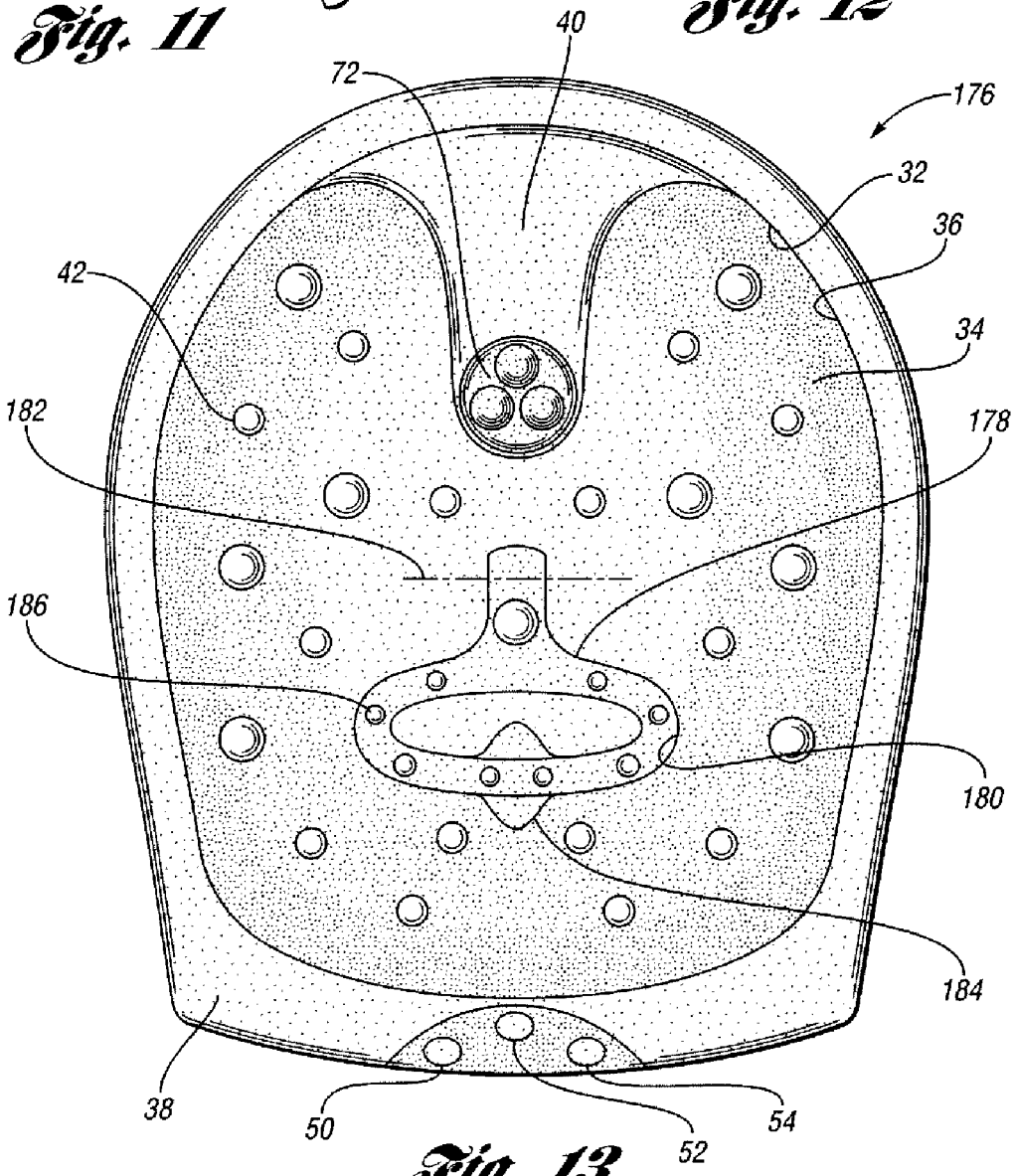
FIG. 13 is a top plan view of an alternative embodiment bath apparatus in accordance with the present invention.

Referring now to FIG. 13, another alternative bath apparatus 176 is illustrated in accordance with the present invention. The bath apparatus 176 includes a handle 178 that is disposed within a recess 180 formed within the bath chamber bottom surface 34. The handle 178 is pivotally connected to the bath chamber bottom surface 34 about a pivot axis 182 that is generally aligned with a center of gravity of the bath apparatus 176. A pair of notches 184 are provided within the recess 180 so that the user may grasp the handle 178 and translate the handle 178 from a retracted orientation to an extended orientation. In the retracted orientation, the handle 178 is aligned generally flush with the bath chamber bottom surface 34. Thus, a top surface of the handle 178 forms part of the bath chamber bottom surface 34. Accordingly, massage nodes 186 may be provided on the handle 178 for providing a uniform massage node pattern along the bath chamber bottom surface 34. The bath apparatus 176 provides the handle 178 in an orientation that both assists manual transportation and conceals the handle 178 when not in use.

Figure 14A:
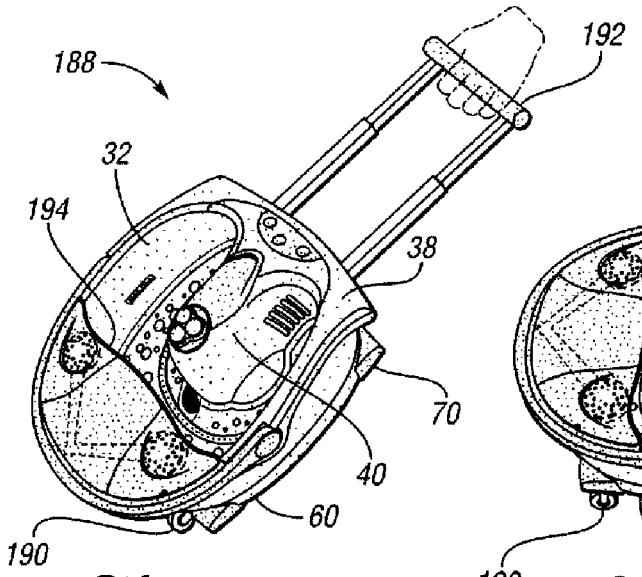
FIG. 14*a* is a perspective view of another alternative embodiment bath apparatus in accordance with the present invention.

With reference to FIG. 14*a*, an alternative embodiment bath apparatus 188 is illustrated in accordance with the present invention. The bath apparatus 188 includes a pair of wheels 190 disposed along a lower region of the lower housing portion 60. Additionally, a telescoping handle 192 is provided that retracts beneath the lower housing portion 60 and also extends therefrom, as illustrated in FIG. 14*a*, so that a user may grasp the handle and transport the bath apparatus 188 upon the wheels 190. The bath apparatus 188 includes a lid 194 so that the bath apparatus can be transported with fluid contained therein so that when the bath apparatus 188 is tilted to an angle, as illustrated in FIG. 14*a*, the bath chamber 32 and the lid 194 collectively retain the fluid therein.

Figure 14B:
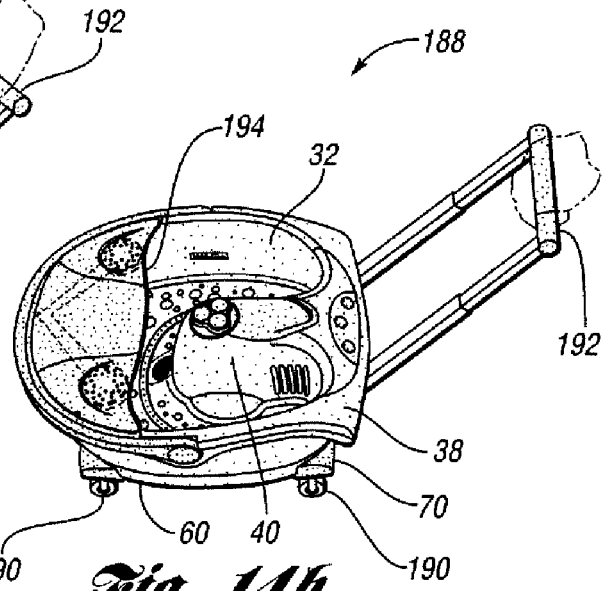
FIG. 14*b* is a perspective view of another alternative embodiment bath apparatus in accordance with the present invention.

The bath apparatus 188 may also have a total of four wheels 190 as illustrated in FIG. 14*b* for transporting the bath apparatus 188. Each wheel 190 may be disposed beneath one of the feet 70, and may be retractable into the lower housing portion 60. Additionally the telescoping handle 192 may be pivotally connected to the lower housing portion 60 in the extended position so that the handle 192 may extend upward from the bath apparatus 188. By providing four wheels 190 on the bath apparatus 188, the user may transport the bath apparatus 188 generally horizontally when filled with fluid, thereby minimizing the likelihood of spilling.

Figure 15:
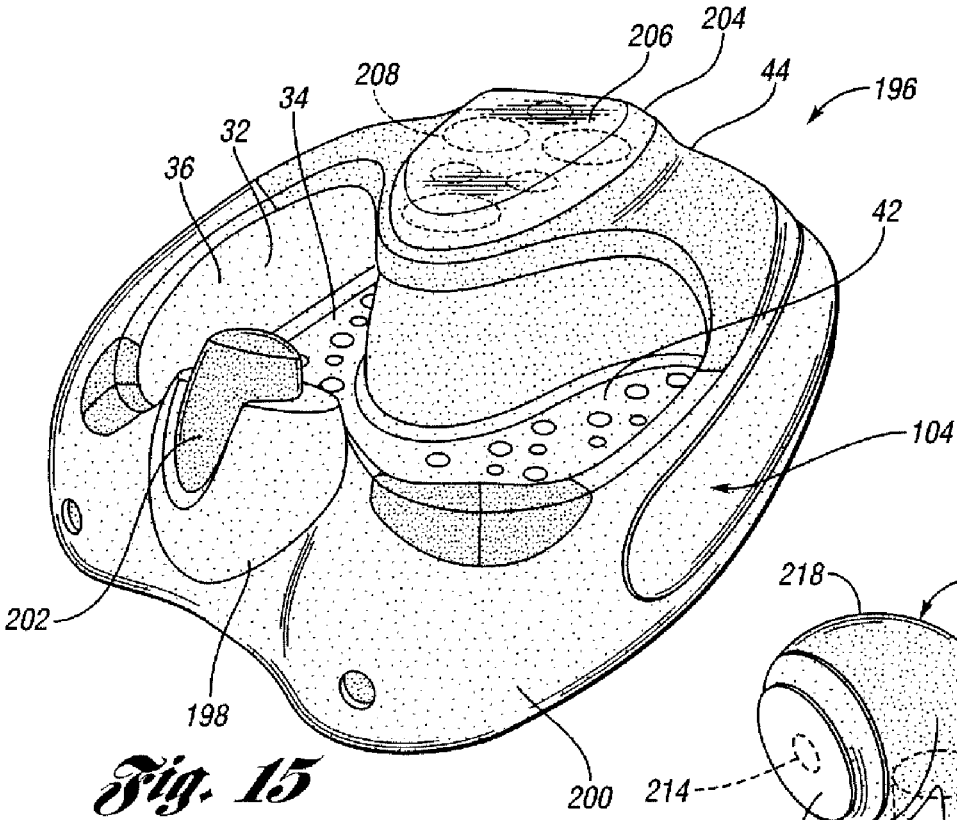
FIG. 15 is a perspective view of the bath apparatus of FIG. 5, illustrated with a pedicure apparatus in accordance with the present invention.

FIG. 15 illustrates an alternative embodiment bath apparatus 196 in accordance with the present invention. The bath apparatus 196 is provided with a pedicure station 198. The pedicure station 198 is a receptacle formed within a housing 200 of the bath apparatus 196 that retains a motorized operational assembly, such as a motorized pedicure apparatus 202, for imparting a rotary pedicure effect to a body part of a user, particularly to the foot. Pedicure apparatuses are well known in the art, for providing treatment to the feet of a user. Pedicure apparatuses are often provided with multiple interchangeable attachments. Accordingly, a secondary lid 204 is pivotally connected to the lid 44 for enclosing a compartment 206 therebetween which retains a plurality of interchangeable pedicure attachments 208.

The pedicure station 198 is generally angled toward the bath chamber 32 so that the pedicure apparatus 202 is positioned whereby a user may place a body part against an attachment of the pedicure apparatus 202 for applying a rotary pedicure effect thereto. Alternatively, the user may manually grasp the pedicure apparatus 202 and remove it from the pedicure station 198 for conveying the pedicure apparatus 202 to the body part, rather than conveying the body part to the pedicure apparatus 202.

Figure 16:
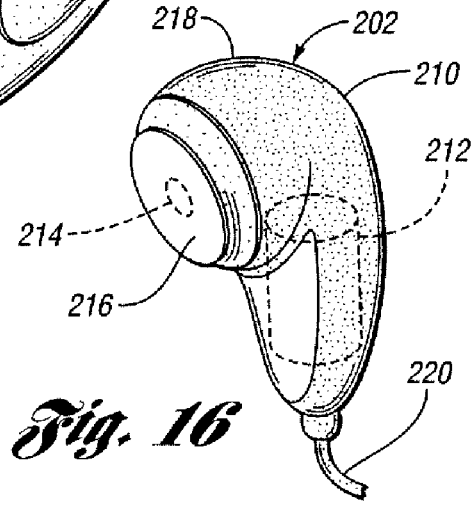
FIG. 16 is an enlarged perspective view of the pedicure apparatus of FIG. 15.

With reference now to FIG. 16, the pedicure apparatus 202 is illustrated in enlarged and in greater detail. The pedicure apparatus 202 has an elongate housing 210 that is sized to be grasped by a user. The pedicure apparatus 202 includes a motor 212 oriented within the housing 210. The motor 212 drives an output spindle 214. The output spindle 214 is adapted to receive multiple pedicure attachments 208 such as pedicure attachment 216 for providing a variety of rotary pedicure effects to the user. These pedicure attachments 208 may include coarse, medium and fine pumice characteristics, as well as brushes, rollers and the like.

The housing 210 is further provided with an elastomeric grip surface 218, which may be overmolded over the housing 210 for providing comfort to the grip of the user and for enhancing the grip of the user.

The pedicure apparatus 202 may be attached to the pedicure station 198 via a tether 220. The tether 220 avoids misplacement of the pedicure apparatus 202 from the bath apparatus 196. Additionally, the tether 220 includes conductive wiring therein for providing a power source from the bath apparatus 196 to the motor 212 of the pedicure apparatus 202. Further, the tether 220 may be retractable within one of the pedicure station 198 and the pedicure apparatus housing 210 for providing cord management of the tether 220.

Figure 17:
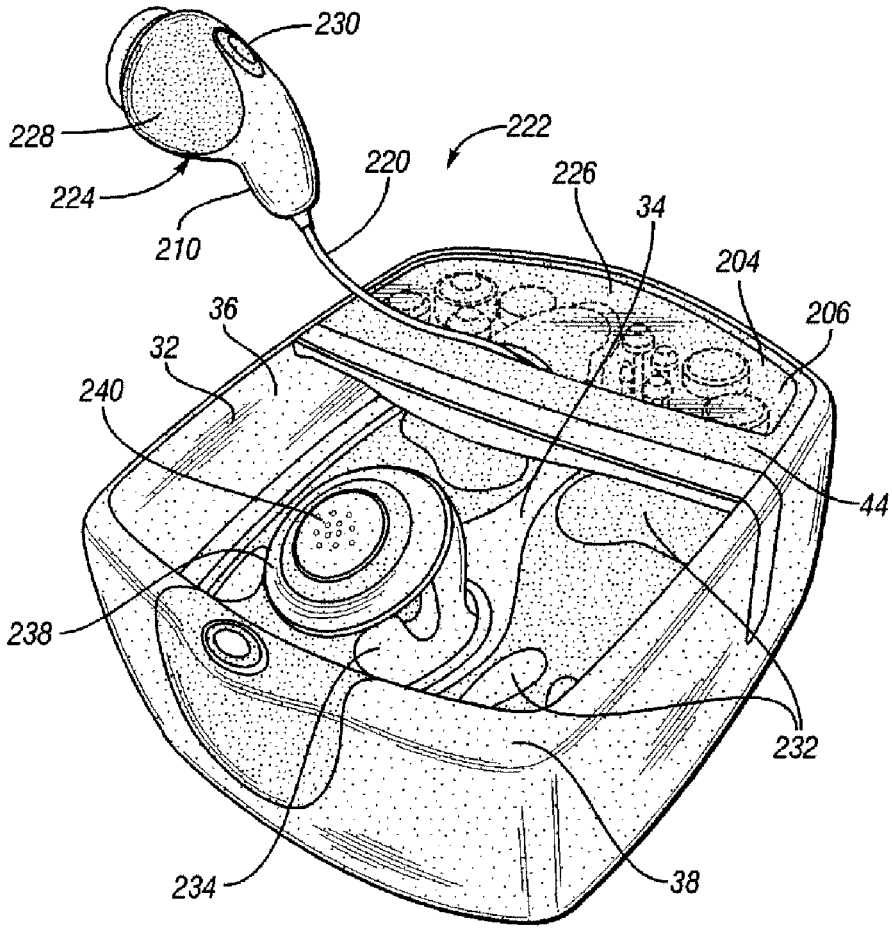
FIG. 17 is a perspective view of yet another alternative embodiment bath apparatus in accordance with the present invention.

With reference now to FIG. 17, another alternative embodiment bath apparatus 222 is illustrated in accordance with the present invention. The bath apparatus 222 includes a pedicure apparatus 224 having a pedicure station 226 within the pedicure attachment compartment 206. Additionally, the pedicure apparatus 224 has an elastomeric grip surface 228 that is contoured about a forward portion of the housing 210 and partially surrounds an on/off switch 230 of the pedicure apparatus 224.

The bath apparatus 222 further includes a series of comfort attachments 232 for enhancing the therapeutic effects of the bathing operation. The comfort attachments 232 may be interchangeable and may include the options of gel pads, loofahs, pumice, bristles, or the like. The invention contemplates that the bristles may be provided in various arrangements with varying densities and lengths. The bristles may be utilized for cleaning of the feet or for providing a comfortable artificial turf feel to the underside of the use's feet.

Figure 18:
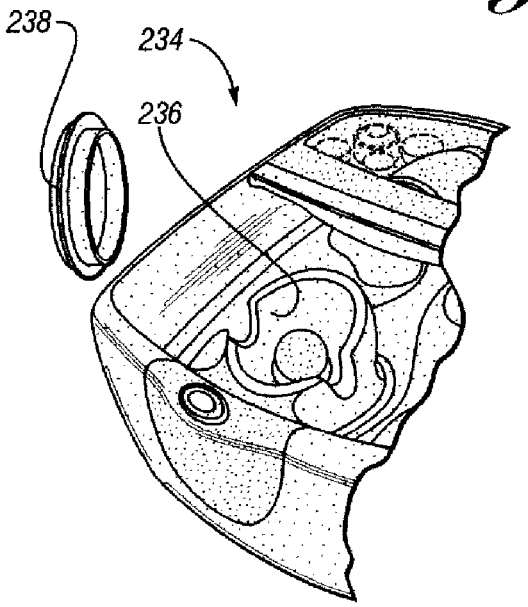
FIG. 18 is an enlarged partially exploded perspective view of a fluid dispenser of the bath apparatus of FIG. 17.

The bath apparatus 222 also includes a peninsular contact portion 234 extending from the bath chamber 32. With reference to FIGS. 17 and 18, the contact portion 234 includes a reservoir 236 for retaining a therapeutic additive, such as lotion, therein. The contact portion 234 further includes a dome-shaped cover 238 that is generally flexible and has a series of apertures 240 formed therethrough. The user may dispense a fluid from the reservoir 236, such as lotion, by depressing cover 238 with a body part so that the lotion is dispensed through the apertures 240 upon the body part.

Figure 19:
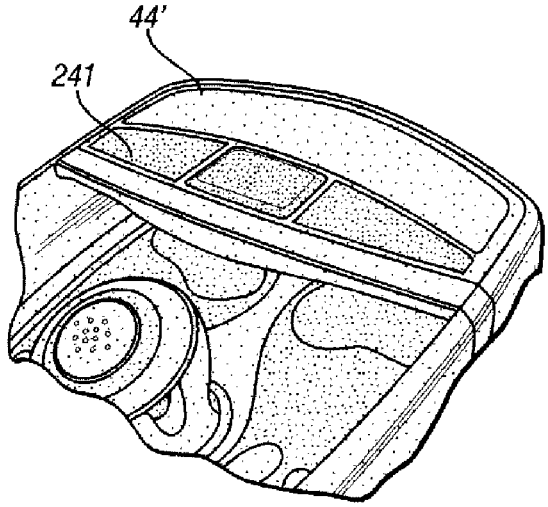
FIG. 19 is an enlarged perspective view of an alternative lid for the bath apparatus of FIG. 17.

Referring now to FIG. 19, the lid 44' of the bath apparatus may include multiple inserts 241 for providing various therapeutic pedicure effects. For example, the inserts 241 may be formed from pumice, loofah, bristles, gel pads, or the like. Additionally, the inserts may be generally transparent to view an operation performed beneath the lid 44', such as a pressurized fluid massage effect.

Figure 20:
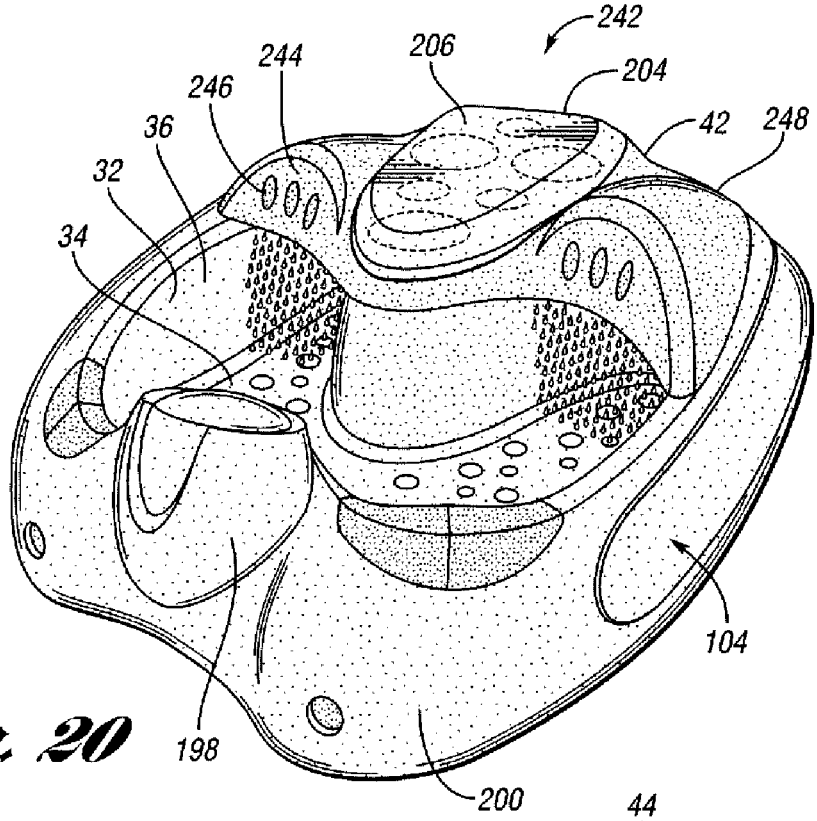
FIG. 20 is a perspective view of an alternative embodiment bath apparatus in accordance with the present invention.

In FIG. 20, an alternative embodiment bath apparatus 242 is illustrated in accordance with the present invention. The bath apparatus 242 includes a contoured lid 244 having showerheads 246, 248 formed on the underside thereof for providing a pressurized fluid massage effect upon a top surface of a use's feet. The bath apparatus 242 may be provided with a pedicure station 198 for retaining a motorized pedicure apparatus.

Figure 21:
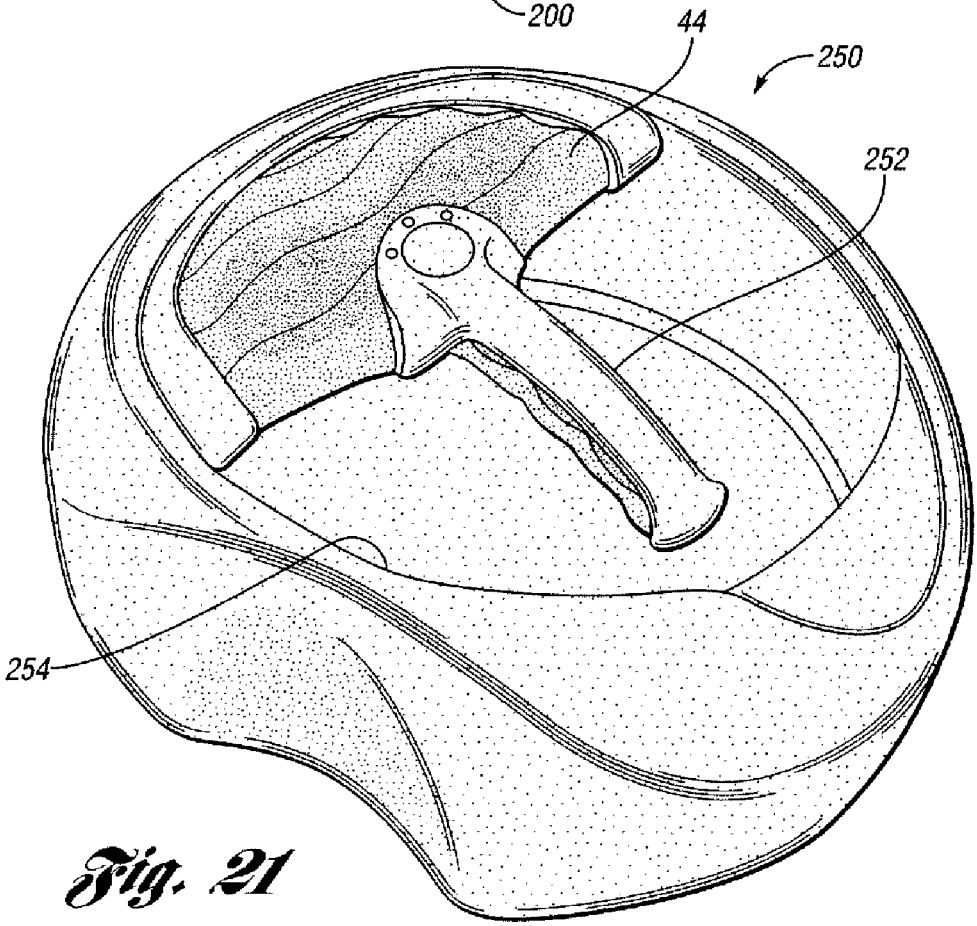
FIG. 21 is a perspective view of another alternative embodiment bath apparatus in accordance with the present invention.

FIG. 21 illustrates another alternative embodiment bath apparatus 250. The bath apparatus 250 includes a handle 252 that is integrated into an opening of a bath chamber 254. The handle 252 may be fixed relative to the bath chamber 250 or may be pivotally connected thereto. The handle 252 is displaced above the center of gravity of the bath apparatus 250 and does not need to be retracted during operation.

Figure 22:
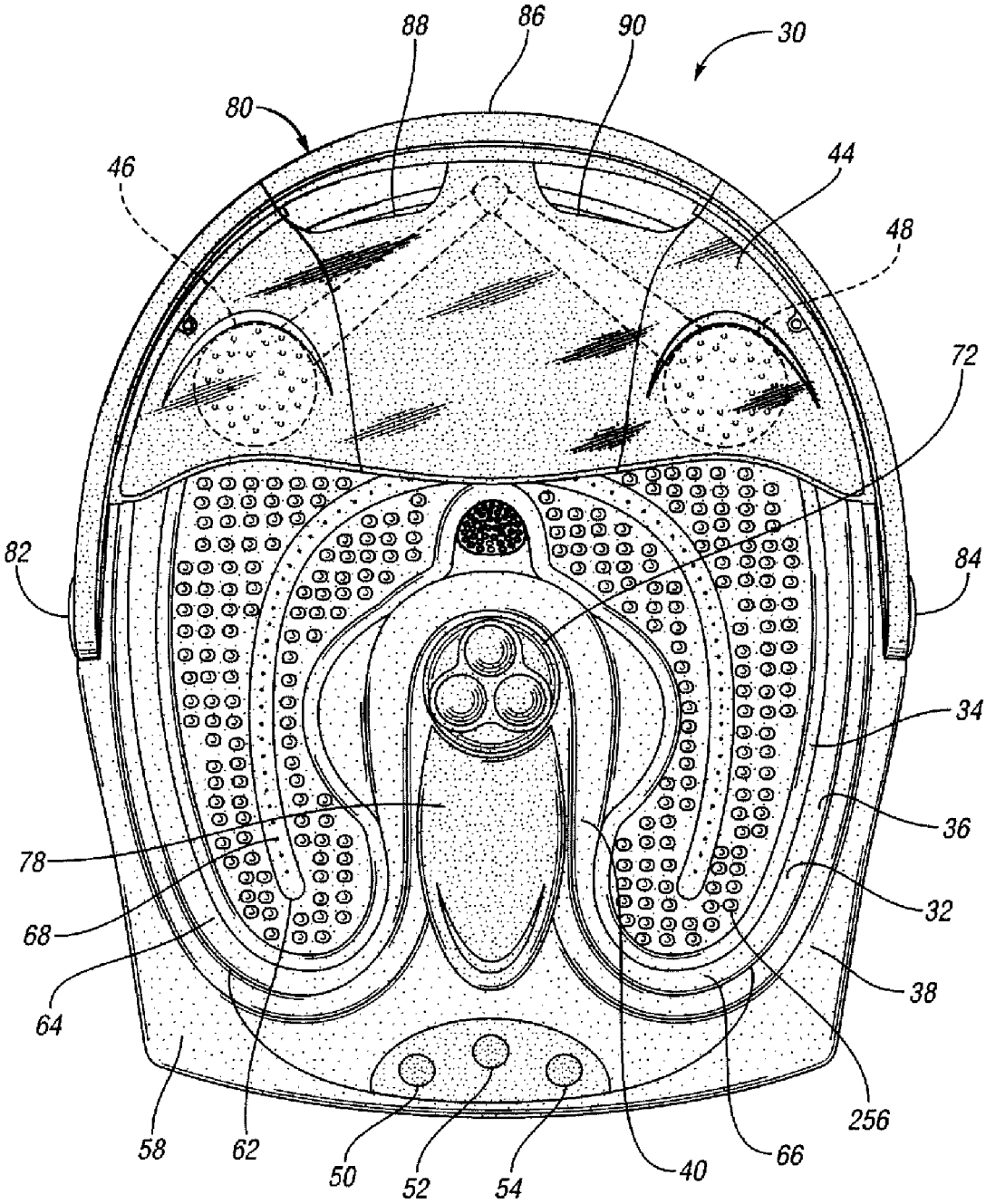
FIG. 22 is a top plan view of the bath apparatus shown in FIG. 1, illustrated with a bristle pad in accordance with the present invention.

Referring now to FIG. 22, the bath apparatus 30 from FIGS. 1-3 is illustrated with a removable comfort attachment disposed therein. Specifically, a bristle pad 256 is inserted into the bath chamber 32. The bristle pad 256 is sized to rest upon the bath chamber bottom surface 34 and may include suction cups for securing the bristle pad 256 to the bath chamber bottom surface 34. Additionally, the bristle pad 256 is formed to provide clearance for the egress strip 62 so that the bubbling massage effect is not interfered with by the bristle pad.

Figure 23:
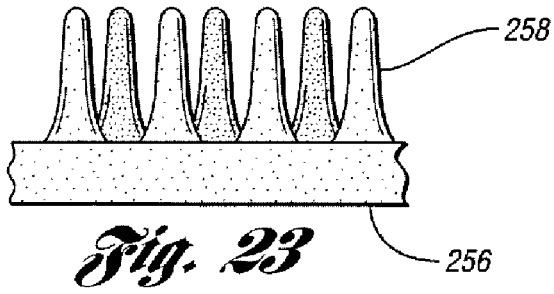
FIG. 23 is an enlarged fragmentary side elevation view of the bristle pad of FIG. 22.

FIG. 23 illustrates an enlarged fragmentary side elevation of the bristle pad 256. The bristle pad 256 includes a series of elastomeric bristles 258 extending from the pad 256. The bristles 258 are formed from a low durometer material so that the bristles 258 are flexible and comforting to the feet of the user. The bristles 258 provide a feel similar to artificial grass or turf and may provide a bristle massage effect to the feet of the user. The invention contemplates that the bristles 258 may have varying lengths, widths, densities, or other characteristics.

During the vibrational massage operation of the bath apparatus 30, the bristles 258 convey a flexible vibratory massage effect upon the feet of the user. Additionally, the bristles 258 may enhance the flow of fluid beneath the use's feet thereby soothing the undersides of the feet.

In summary, multiple auxiliary features are provided for adding to the overall bathing and therapeutic experience, while enhancing transportation and incorporating products that are typically provided separate from bathing apparatuses.

While embodiments of the invention have been illustrated and described, it is not intended that these embodiments illustrate and describe all possible forms of the invention. Rather, the words used in the specification are words of description rather than limitation, and it is understood that various changes may be made without departing from the spirit and scope of the invention.

What is claimed is:

1. An apparatus for bathing a body part, the apparatus comprising:

a bath chamber for containing fluid, the bath chamber having an opening for receiving the body part therein;

a housing mounted to the bath chamber, the housing providing a base for supporting the bath chamber upon an underlying support surface;

a handle mounted to one of the bath chamber and the housing for providing a grip portion extending above the bath chamber, wherein the handle grip portion can be displaced generally above a center of gravity of the apparatus for facilitating manual transportation of the apparatus when fluid is retained in the bath chamber; and an operational assembly in cooperation with the housing for imparting a therapeutic effect to the bath chamber;

wherein the handle is pivotally mounted to one of the bath chamber and the housing, for rotation of the handle between a retracted and an extended position;

wherein the bath chamber includes a peripheral rim extending about the opening and the handle forms part of the rim in the retracted position; and wherein the operational assembly is motorized for imparting a motorized therapeutic effect to the bath chamber.

2. The apparatus of claim 1 further comprising a lid mounted to the bath chamber opening, the lid being sized to extend partially over the bath chamber, the lid having a spout formed therethrough for facilitating disposal of the fluid retained therein.

3. An apparatus for bathing a body part, the apparatus comprising:

a bath chamber for containing fluid, the bath chamber having an opening for receiving the body part therein;

a housing mounted to the bath chamber, the housing providing a base for supporting the bath chamber upon an underlying support surface;

a handle mounted to one of the bath chamber and the housing for providing a grip portion extending above the bath chamber, wherein the handle grip portion can be displaced generally above a center of gravity of the apparatus for facilitating manual transportation of the apparatus when fluid is retained in the bath chamber;

wherein the handle is pivotally mounted to one of the bath chamber and the housing, for rotation of the handle between a retracted and an extended position;

wherein the bath chamber includes a peripheral rim extending about the opening and the handle forms part of the rim in the retracted position;

a contact area portion adapted to be uncovered by fluid contained within the bath chamber;

a flexible contact pad mounted on the contact area for providing padded support to a body part; and at least one motorized massage attachment adapted to be received on the contact area for massaging the body part when the body part engages the motorized massage attachment, the motorized massage attachment being oriented adjacent to the contact pad so that the user may rest the body part upon the contact pad while engaging the motorized massage attachment.

4. The apparatus of claim 1 wherein the handle is generally arcuate with a pair of ends, each pivotally mounted to the lateral sides of one of the bath chamber and the housing, for rotation of the handle between a retracted and an extended position.

5. An apparatus for bathing a body part, the apparatus comprising:

a bath chamber for containing fluid, the bath chamber having an opening for receiving the body part therein, the bath chamber having a plurality of egress apertures formed therethrough in operable communication with an air pump for forcing air into the bath chamber through the egress apertures to provide a bubbling massage effect to the underside of the body part received in the bath chamber;

a housing mounted to the bath chamber; and a removable bristle pad that is sized to be placed within the bath chamber for providing a therapeutic bristle massage effect to the body part, the bristle pad being sized to provide clearance for the plurality of egress apertures.

6. The apparatus of claim 5 further comprising an operational assembly in cooperation with the housing for imparting a therapeutic effect to the bath chamber.

* * * * *